United States Patent [19]

Arrowood

[11] 4,058,859

[45] Nov. 22, 1977

[54] WATER CLOSET CARRIER

[75] Inventor: Gordon W. Arrowood, Palmetto, Ga.

[73] Assignee: McKenney's, Inc., Atlanta, Ga.

[21] Appl. No.: 657,074

[22] Filed: Feb. 11, 1976

[51] Int. Cl.[2] ..... E03D 11/14

[52] U.S. Cl. ..... 4/252 R; 248/295

[58] Field of Search ..... 4/68, 252 R, 252 A, 4/187 M; 285/56, 61, 64; 151/44, 54; 248/59, 70, 295, 298

[56] References Cited

U.S. PATENT DOCUMENTS

| | | | |
|---|---|---|---|
| 269,874 | 1/1883 | Moore et al. | 248/295 X |
| 1,545,839 | 7/1925 | Mason | 4/252 R |
| 1,795,296 | 3/1931 | Zeng | 248/295 |
| 3,435,467 | 4/1969 | Flegel et al. | 4/252 R |
| 3,495,283 | 2/1970 | Studer | 4/252 R |
| 3,732,582 | 5/1973 | Mielbeck | 4/252 R |

*Primary Examiner*—Richard E. Aegerter
*Assistant Examiner*—Stuart S. Levy
*Attorney, Agent, or Firm*—Newton, Hopkins & Ormsby

[57] ABSTRACT

A water closet carrier of the type which supports an off-the-floor toilet, the carrier having a pair of upstanding slotted brackets which support a vertically disposed face plate, selectively positionable in angularly related positions with respect to the brackets. Racks along the inner surfaces of the slots cooperate with pinion nuts on the mounting studs of the face plate for vertically positioning the face plate. A branch pipe projects through the face plate and is clamped by an encircling strap to tabs projecting from the face plate. The pipe, in turn, is clamped, by an O-ring and a compression plate, to the discharge port of the toilet carried on the opposite side of a wall by the mounting studs.

6 Claims, 3 Drawing Figures

WATER CLOSET CARRIER

BACKGROUND OF THE INVENTION

1. FIELD OF THE INVENTION

This invention relates to water closet carriers and is more particularly concerned with a water closet carrier which will support a wall mounted or off-the-floor type water closet.

2. DESCRIPTION OF THE PRIOR ART

In the past, off-the-floor type water closet supports have been extensively used, due to the desirability of having a wall mounted or off-the-floor type water closet, toilet or commode so as to facilitate the cleaning beneath the fixture. Such installations, however, have been extremely expensive and difficult to install, requiring minute adjustments in order to position the carrier or support in an appropriate position to receive the water closet, support it horizontally at the proper height, and permit its proper drainage into a waste pipe. Therefore, it has been estimated that the installation of a wall mounted or off-the-floor type water closet, toilet or commode, requires approximately six man-hours of work.

The requirement with respect to a wall mounted water closet, commode or toilet is usually that the fixture be capable of supporting 300 pounds, in a cantilever fashion, at a distance of 2 feet from the wall. This, of course, places tremendous pressures upon the mounting studs or fixture bolts which are required for such an installation.

The present invention provides an inexpensive water closet carrier which can, more readily and easily, be installed and quite accurately manipulated to level the water closet at an appropriate height.

SUMMARY OF THE INVENITON

Briefly described, the present invention includes a water closet carrier which is provided with a pair of upstanding brackets, the feet or bases of which are firmly embedded, bolted or otherwise affixed to the flooring within the space between adjacent walls. A face plate, which carries a plurality of aligned mounting studs or fixture bolts, is mounted on the upstanding brackets so that the mounting studs project through appropriate vertically disposed slots in the brackets, there being provided suitable nuts on the studs for clamping the studs firmly to the face plate and on the brackets and also to the commode. At the bracket, one or more of the studs is provided with a pinion nut having a pinion which meshes with a rack, formed along the inside area defining the slot, through which the stud projects, so that, through manipulation of the nut, the face plate may be incrementally raised or lowered, as desired.

A branch pipe projects through the face plate and is clamped by a strap to tabs which project from the face plate. The mounting studs, as well as the pipe, project through appropriate openings in the wall of the building so that the bowl stabilizer nuts and the mounting studs function to receive and support the water closet. The forward end of the drain pipe is clamped by an O-ring and a compression plate to the toilet carried by the mounting studs.

DESCRIPTION OF THE PREFERRED EMBODIMENT

Figure 1:
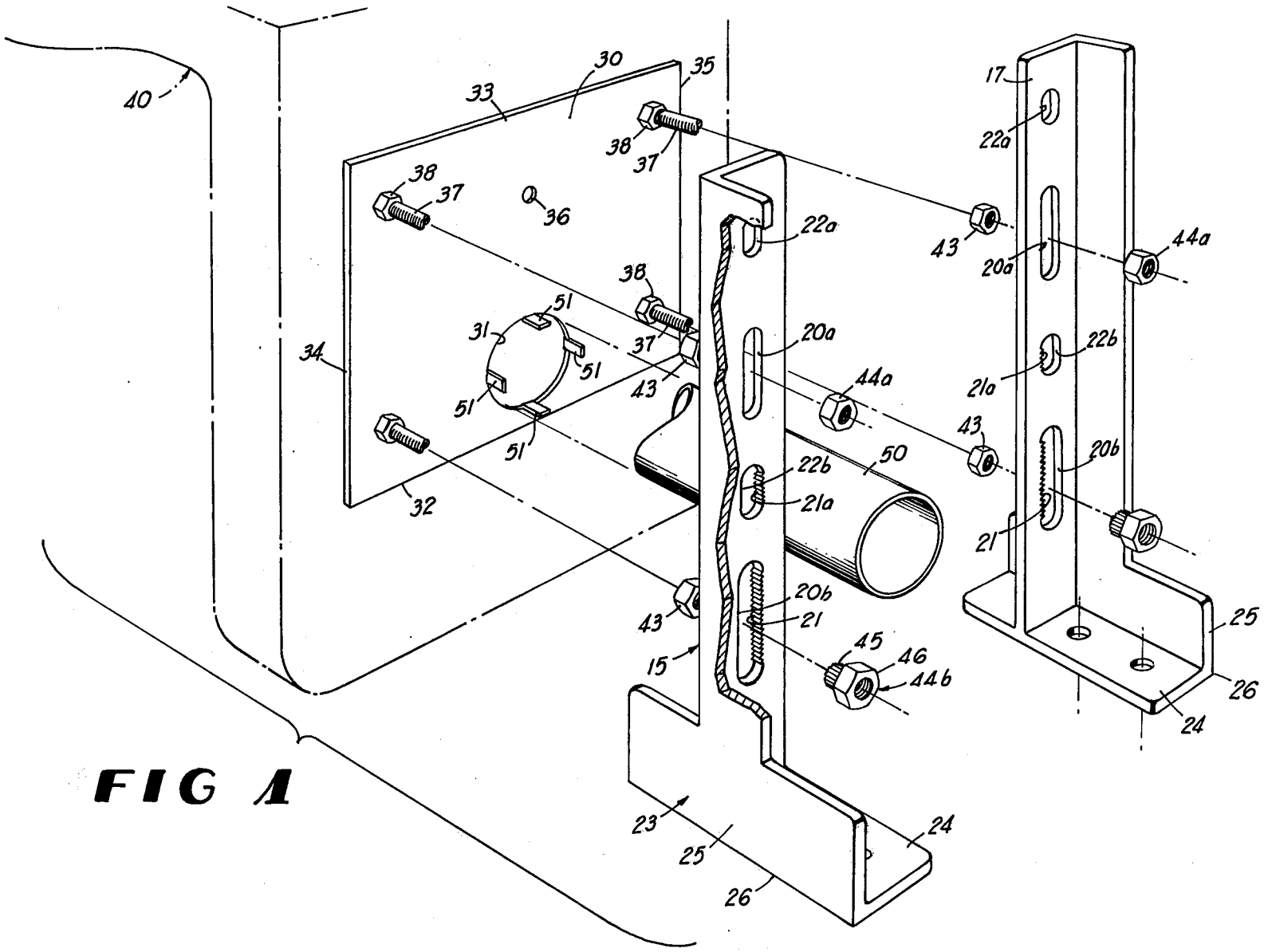
FIG. 1 is an exploded perspective view of a water closet carrier constructed in accordance with the present invention and supporting a fixture, such as a commode, toilet or water closet, from the floor of a building.
Figure 2:
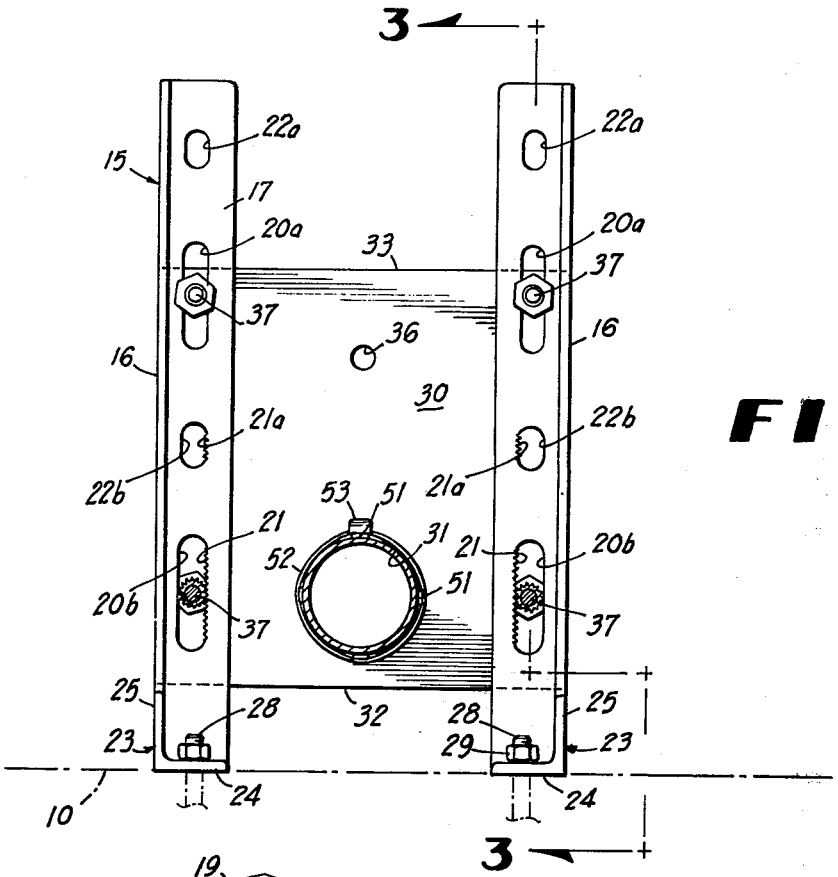
FIG. 2 is a rear elevational view of water closet carrier disclosed in FIG. 1.

Referring now in detail to the embodiment chosen for the purpose of illustrating the present invention, numeral 10 denotes generally the floor of a building which is to receive the wate closet. This building also includes upright studs or channel members 11 which are usually on sixteen inch centers for supporting the vertical walls 12 of the building. The water closet carrier of the present invention is mounted between the studs 11 and between the walls 12, with the other plumbing, as will be pointed out hereinafter.

The wall closet carrier of the present invention includes a bracket member 14 having a pair of opposed, complementary, paralle, upstanding supporting brackets 15. Each of support brackets 15 includes an upstanding or vertically disposed brace in the form of an angle iron, the brace including an upright longitudinal flange 16 and an upright transverse flange 17 which are disposed perpendicularly to each other so as to be integrally joined along a common straight edge 18. The flanges 17 are coplanar with each other, being in a common vertical plane parallel to and spaced inwardly of wall 12. The flanges 16 are parallel to each other. The flanges 16 are provided with one or a plurality of holes 19 for the purpose of mounting the flange 16 against a surface of an upright stud or channel member, such as stud 12, within the wall frame of the building.

Each flange 17 is provided with a pair of spaced, vertically aligned, elongated upper and lower main slots **20*a* and 20*b*. Along the inner edge of each lower slot 20*b*, there is a straight rack 21 integrally formed in the edge, itself. This rack 21 is vertically disposed and runs throughout substantially the length of each of the lower slots 20*b*** for purposes to be described hereinafter.

Above the main slots **20*a* in flanges 17 are smaller holes, apertures or slots 22*a*. Above the slots 20*b*, but below slots 20*a*, are smaller slots 22*b*. The inner surfaces defining slots 22*b* are provided with teeth or racks 21*b*. The purposes of these slots 22*a*, 22*b*** will be described hereinafter.

At the lower ends of the upright brackets, there are provided opposed complementary feet or bases 23 which include opposed, horizontal, flat, coplanar, inwardly extending flanges 24 and vertical flanges 25 respectively joined along common edges 26 to the flanges 24. Holes 27 in flanges 24 receive upstanding mounting bolts 28 which are embedded in floor 10 and these bolts 28 receive nuts 29, by means of which the flanges 24 are firmly anchored to floor 10. Thus, the feet 23 mount the opposed upright brackets 15 quite firmly on floor 10, between the studs 11 and within the adjacent walls 12.

Feet 23 extend both forwardly and rearwardly of brackets 15, the flanges 25 being in common parallel planes with the flanges 16, respectively, and the flanges 24 being perpendicular to and below and abutting the ends of flanges 17.

The face plate, denoted generally by numeral 30, is a flat, sheet metal rectangular or square panel which has an off-center, circular aperture or hole 31, the center of the hole 31 being along the vertical centerline of plate 30 but below the horizontal centerline. In other words, the center of hole 31 is closer to the lower straight edge 32 of the face plate 30 than the straight upper edge 33, the edges 32 and 33 being parallel to each other.

On the other hand, the center of hole 31 is equidistant between the side edges 34 and 35 of plate 30, the side edges 34 and 35 being parallel to each other perpendicular to the edges 32 and 33. Therefore, by rotating the plate 30, so as to dispose the edge 33 below the edge 32, the position of the hole 31 may be raised from the position shown in FIG. 1. Also, by making the edge 34 or the edge 35 the lower edge, the effective position of hole 31 may be shifted, laterally. A hole 36 or a plurality of such holes in plate 30 permits reinforcing bolts (not shown) to be used, if desired.

For mounting the plate 30 in a vertical plane parallel to and inwardly of wall 12 on the upstanding brackets 15 and also for mounting a commode, toilet or water closet 40 in place, there are a plurality of straight, parallel, horizontal, cylindrical studs 37 which respectively pass through appropriate holes in the corner portions of the plate 30. These mounting studs or fixture bolts 37 are externally threaded throughout their length and each protrudes in both directions from plate 30. The studs or bolts 37 are disposed parallel to each other and perpendicular to the plate 30. The studs 37 are retained in place by locking nuts 38, best seen in FIG. 3. These locking nuts 38 are threaded onto opposite end portions of the mounting stud or fixture 37 and are thereafter tightened up until they abut opposite sides of plate 30. Thus, the nuts 38 sandwich the plate 30, therebetween. By manipulation of the nuts 38, the effective length of each of the mounting bolts or studs 37 may be varied so as to increase or decrease the effective length of the stud 37 in one direction or the other, with respect to plate 30.

Figure 3:
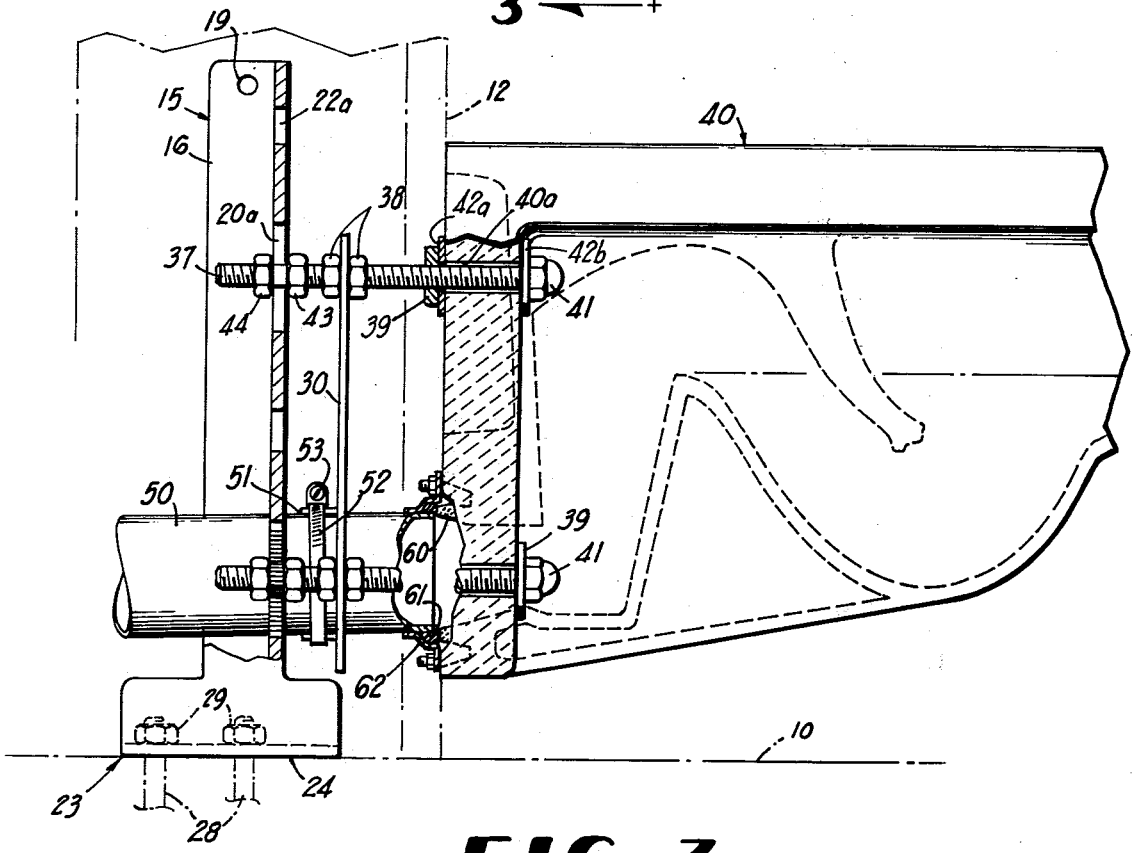
FIG. 3 is a vertical sectional view taken substantially along line 3—3 in FIG. 2.

In use, the outer end portions of bolts 37 protrude through appropriate holes in wall 12 and extend a short distance therefrom. Load carrying bowl stabilizing nuts or fasteners, such as nut 39 provided with washers such as washer **42*a*, are threadedly received on the bolts 37 to form inner bearing surfaces and a fixture, such as a commode, toilet, water closet or bowl 40 is inserted on the bolts 37, the bolts extending respectively through the holes 40*a* in the commode 40 and then receiving washers 42*b* and load bearing bowl stabilizer end nuts 41 in the usual way as illustrated in FIG. 3**.

The inner end portions of the studs or fixture bolts 37 are provided with bracket mounting nuts 43 which function to abut the outer surfaces of the flanges 17 as the bolts 37 pass through the slots **20*a* and 20*b* or slots 22*a* and 22*b*, as the case may be. The protruding inner ends of the upper bolts 37 are provided with nuts 44*a* which, when tightened, abut the inner surfaces of the flanges 17, adjacent the slots 20*a***.

According to the present invention, the inner protruding ends of the lower bolts 37 are provided with pinion nuts **44*b*, these pinion nuts serving a double function of locking the lower bolts 37 in place in the slots 20*b*, or 22*b*, and also to provide a means by which the position of the lower bolts 37 may be incrementally altered in a vertical path along the length of the slots 20*b* or slots 22*b*. This incremental altering of the position of the lower bolts 37 and hence the plate 30 and the upper bolts 37, includes a circular pinion 45 fixedly mounted in concentric relationship to a hexagonal head 46 of the nut 44*b*. The pinion 45 is of smaller diameter than the effective diameter of the head 46 and is of a diameter approximately equal to the width of the slot 20*b* or slot 22*b* so that, when the pinion 45 is inserted into the slot 20*b*, the teeth of the pinion 45 mesh with the teeth of the rack 21 or 21*b* and the pinion 45 will not slip along the rack 21 or rack 21*b*, because its movement is arrested by the dimensions of the slot 20*b* or slot 22*b*. Upon rotation, however, of the pinion 45, the nut 44 will walk up and down the rack 21 or rack 21*b***, as desired.

The width of the pinion 45 is slightly less than the thickness of the flange 17 so that regardless of how tight the nuts 43 and **44*b* are tightened against opposite sides of the flange 17, there will not be a binding of the nuts 43 and 44*b* against each other through the slot 20*b* or 22*b*. The head 46 of nut 44*b* is larger in diameter than the width of the slot 20*b* or 22*b* and, hence, when the pinion 45 is inserted into the slot 20*b*, the inner surface of the head 46 abuts the surface of flange 17**.

When the nuts 43 are installed on the bolts 37 and these bolts 37 inserted through the slots **20*a* and 20*b* and, thereafter, the nuts 40*a* and 40*b* installed on the bolts 37, the bolts 37 will be supported in a horizontal position and the plate 30 will be supported essentially parallel to and spaced forwardly of the plane of the flanges 17 in a vertical position. Hence, the plate 30 may be raised or lowered incrementally, through the manipulation of the nuts 43 and 44*b*, the nuts 43 being loosened so that the nuts 44*b* may be rotated slightly to raise or lower the height of the assembly which includes the bolts 37 and plate 30. Of course, once an appropriate position has been reached by the nuts 43*b*, the nuts 43 can be tightened to lock the lower bolts 37 in appropriate height. Thereafter, the nuts 43 may be tightened with respect to the nuts 44*a* for any slight tilting of the plate 30 as to maintain the plate 30** in an essentially vertical position.

For the purpose of supporting a branch pipe 50, which passes through the hole 31 of the plate 30, a plurality of equally radially spaced tabs 51 protrudes perpendicularly from the inner surface of the plate 30, adjacent the portion of the plate 30 defining a hole 31. These tabs are preferably integrally struck from the plate 30 when the hole 31 is produced. The tabs are disposed in circumferentially spaced relationship around and abut the outer surface of the pipe 50 and a metal strap 52 passes circumferentially over the tabs 50 so as to clamp the tabs 51 against the pipe 50. The strap 52 is provided with a take up buckle 53, through which the end portion of the strap is inserted, and upon rotation of the screw within the head 53, the strap 52 is taken up so as to function as a clamp for firmly clamping the pipe 50 to the tabs 51. A conventional hose clamp which has a strap 52 which is slightly more narrow than the length of the tabs 51 is preferably employed.

The forward end of the pipe 50 protrudes into the discharge port or rearwardly opening horn 60 of the commode, or toilet or water closet 40. Surrounding this end portion of pipe 50 is an 0-ring or other form of packing, denoted by numeral 61, the packing being urged into a compressed and sealing relationship circumferentially around the end portion of the pipe 50 and circumferentially around the horn 60 of the commode 40 is a compression plate 62. The compression plate 62 is an essentially flat member which is annular, the inner periphery being tapered to form a fillet which converges to a collar portion 63 which frictionally engages the periphery of pipe 50. As the commode is mounted in place, the wall 12 abuts the inner surface of the flange 61 so as to urge the flange against the O-ring or packing 61 so as to seal the discharge horn 60 of the commode 40, with respect to the end of pipe 50. Since the pipe 50 is clamped firmly in place by the tabs 51 and the strap 52, and the nuts 41 urge the commode inwardly, the flat plate 30, due to minor deflection, yieldably urges the end of the pipe 50 into a seated position in the horn 60. Bolts 63 may secure the flange 61 to the commode 40, if desired.

The present water closet carrier is capable of being used with a regular wall mounted closet bowl, commode, toilet or water closed which is usually mounted some 4 ½ inches to 5 ½ inches off the floor. If, however, a wheelchair closet bowl is to be installed, this closet bowl being mounted some 8 ½ to 9 inches off-the-floor, the plate 30 is rotated 180° from the position shown in the drawings. This will dispose the hole 30 at a position above the centerline of the plate 30. Furthermore, it may be found advantageous to simply raise the entire plate assembly so that the bolts 37 project through the holes **22*a* and 22*b*, whereby the pinions 45 of nuts 44*b* mesh with the teeth of the racks 21*a* of slots 22*b***.

It will be understood by those skilled in the art that the vertical spacing between the slots **20*a* and 20*b* approximately equals the vertical spacing between the vertically aligned bolts 37. Also, the vertical spacing between the slots 22*a* and 22*b* approximately equals the vertical spacing between the bolts 37 so that the bolts readily protrude through the associated pairs of holes 20*a*, 20*b* or 22*a*, 22*b***, as the case may be.

It is now seen that the present carrier is an universal carier in that it fits all three types of water closets or closet bowls which are presently on the market. The regular wall mounted closet bowl 40 can quite readily be received and supported by the structure hereinabove described. The wall mounted wheelchair closet bowl, as explained above, should require only the rotation of the plate 30 or the utilization of the upper pairs of slots, namely the slots **22*a*, 22*b*. The blow-out type bowl is also a bowl which has a drain mounted some 8 ½ to 9 inches above the floor 10**. Therefore, it is readily seen that the present carrier can be utilized with such a blow-out type closet bowl.

I claim:

1. A water closet carrier of the type which supports in cantilever fashion adjacent a vertical wall, an off-the-floor water closet, comprising:

a. an upstanding bracket member;

b. a plurality of studs projecting laterally from said bracket member for projecting outwardly through said vertical wall;

c. means on said studs for securing the rear portion of said water closet thereto; and d. adjustment means interconnected between said bracket member and one of said studs for positively and incrementally adjusting the position of said one of said studs with respect to said bracket member while said adjustment means continuously is interconnected between said bracket member and said one of said studs and while said one of said studs remain projecting laterally wherein said certain of said studs projects through a vertically disposed slot in said bracket member and wherein said adjustment means includes a rack with the teeth of the rack projecting into said slot and disposed along one side portion of said slot, said adjustment means also including a pinion disposed on said stud, said pinion being received in said slot and being of a width approximately equal to the width of said slot so that the teeth of said pinion mesh with the teeth of said rack and the width of the slot is sufficient for rotation of said pinion in said slot but is not sufficiently wide to permit slippage of said pinion along said rack; including a nut threadably carried by certain of said studs and wherein said pinion is connected to and rotated by said nut.

2. The water closet carrier defined in claim 1 including a vertically disposed plate received on said studs, said plate fixing the position of said studs with respect to each other.

3. The water closet carrier defined in claim 2 wherein said plate is provided with a hole for receiving the branch pipe which connects to said water closet and including clamping means for clamping said branch pipe with respect to said plate.

4. The water closet carrier defined in claim 3 wherein said clamping means includes a plurality of circumferentially spaced flexible tabs secured to said plate and projecting therefrom adjacent said hole in said plate, and a strap extending around said tabs for tightening about said tabs to fix the position of said branch pipe with respect to said plate.

5. The water closet carrier defined in claim 4 wherein said studs project in both directions from said plate, said plate being spaced laterally with respect to said bracket member and being disposed in essentially a vertical position.

6. The water closet carrier defined in claim 5 wherein the hole in said plate is off center, the center of said hole being equidistant between the side edges of said plate and being closer to one transverse edge than the other transverse edge of said plate. /

* * * * *